US006129452A

United States Patent [19]

Hakulin

[11] Patent Number: 6,129,452

[45] **Date of Patent: *Oct. 10, 2000**

[54] COMBINED BEACH TOWEL AND CARRYING CASE

[76] Inventor: Ruth P. Hakulin, 201 Cresswell Rd., Baltimore, Md. 21225

[ * ] Notice: This patent issued on a continued prosecution application filed under 37 CFR 1.53(d), and is subject to the twenty year patent term provisions of 35 U.S.C. 154(a)(2).

[21] Appl. No.: 09/208,951

[22] Filed: Dec. 9, 1998

[51] Int. Cl.[7] ..... B65D 33/00

[52] U.S. Cl. ..... 383/4; 5/417

[58] Field of Search ..... 383/4; 5/417, 419, 5/420

[56] References Cited

U.S. PATENT DOCUMENTS

| | | | |
|---|---|---|---|
| 4,085,873 | 4/1978 | Schweitzner | 383/4 |
| 4,154,323 | 5/1979 | Sneider | 383/4 |
| 4,375,111 | 3/1983 | Hall | 383/4 |
| 4,600,091 | 7/1986 | McLeod | 383/6 |
| 4,789,247 | 12/1988 | Schnoor | 383/4 |
| 5,390,381 | 2/1995 | LaMantia | 383/4 |
| 5,454,643 | 10/1995 | Sullivan | 383/4 |
| 5,533,653 | 7/1996 | Kaufman | 383/38 |
| 5,618,110 | 4/1997 | Sullivan | 383/4 |
| 5,629,071 | 5/1997 | Feldman | 428/192 |
| 5,644,807 | 7/1997 | Battistella | 5/419 |
| 5,688,052 | 11/1997 | Compton | 383/4 |
| 5,730,529 | 3/1998 | Fritz et al. | 383/4 |
| 5,774,912 | 7/1998 | Dominique | 5/419 |
| 5,785,219 | 7/1998 | Kraft | 383/4 |
| 5,843,556 | 12/1998 | Levas | 383/4 |

*Primary Examiner*—Stephen P. Garbe
*Attorney, Agent, or Firm*—Henderson & Sturm LLP

[57] ABSTRACT

A combined beach blanket carrying case arrangement 10 including a main fabric unit 11 that includes a single thickness fabric panel member 20 that defines the body of the beach blanket 50 and a double thickness fabric envelope 30 which defines both the head of the beach blanket and the body of the carrying case depending on the mode of deployment of the arrangement 10. The fabric envelope 30 defines a main storage compartment 31 and a pair of side storage compartments 32 and 33 and wherein the main storage compartment 31 is further provided with a carrying strap member 60.

7 Claims, 1 Drawing Sheet

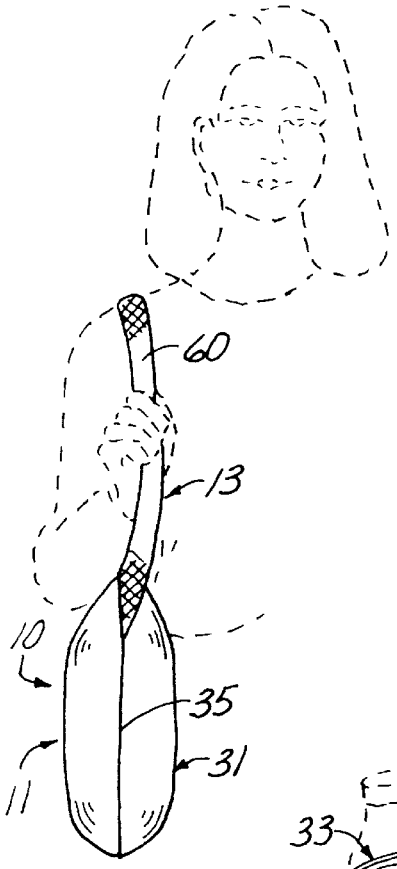
Fig. 1
Fig. 2
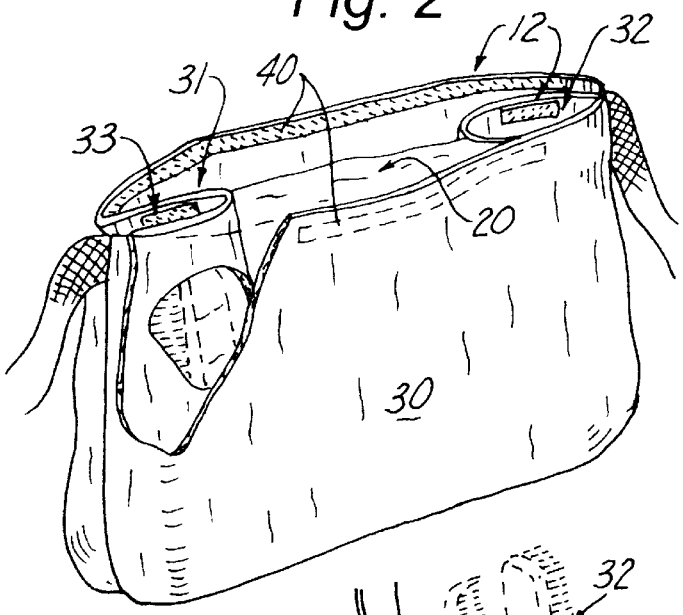
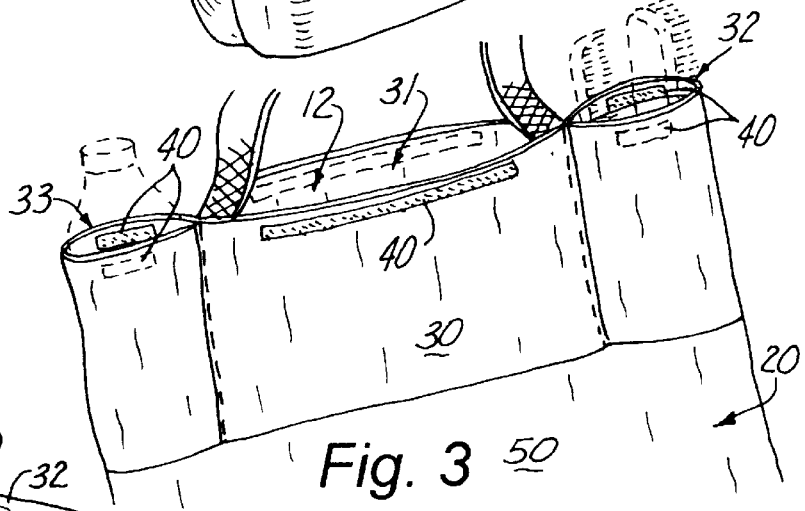
Fig. 3
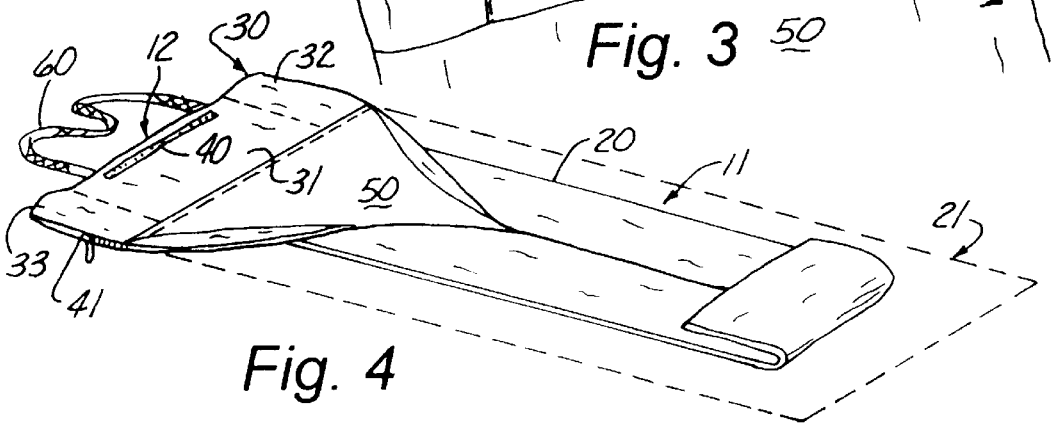
Fig. 4

COMBINED BEACH TOWEL AND CARRYING CASE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of beach towels that can be folded up into a carrying case in general, and in particular to such an arrangement wherein the folding process also creates internal pockets within the case.

2. Description of Related Art

As can be seen by reference to the following U.S. Pat. Nos. 4,789,247; 5,629,071; 5,644,807; and 5,730,529, the prior art is replete with myriad and diverse foldable blanket/carrying case arrangements.

While all of the aforementioned prior art constructions are more than adequate for the basic purpose and function for which they have been specifically designed, they are uniformly deficient with respect to their failure to provide a simple, efficient, and practical blanket/carrying case arrangement wherein the act of folding and joining opposed blanket surfaces not only creates a carrying case, but also creates internal sealable closures within the carrying case for transporting sundry articles that are used at the beach and at pool side.

As most sun worshipers are all too well aware, one of the major problems encountered in thoroughly enjoying their past time is the difficulty in securely storing various and sundry discrete tanning accessories, keys and change to their favorite sunbathing location.

As a consequence of the foregoing situation, there has existed a longstanding need for a new and improved type of convertible beach towel and carrying case arrangement, wherein interior sealable enclosures are temporarily formed on the interior of the carrying case embodiment, and the provision of such a construction is a stated objective of the present invention.

BRIEF SUMMARY OF THE INVENTION

Briefly stated, the combined beach towel and carrying case arrangement that forms the basis of the present invention comprises in general a main fabric unit, a carrying strap unit, and a plurality of fastening units.

As will be explained in greater detail further on in the specification, the fabric unit comprises a single thickness fabric panel member which defines the body of the beach blanket and a double thickness fabric envelope that defines both the head of the beach blanket and the body of the carrying case. The fabric envelope is segmented into a main storage compartment and a pair of side storage compartments In addition, the main storage compartment is dimensioned and adapted to receive both the single thickness panel member and both of the side storage compartments when the arrangement is disposed in the carrying case mode wherein the sling unit is operatively attached to the main storage compartment.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein:

FIG. 1 is a perspective view of the carrying case embodiment version of the invention;

FIG. 2 is a perspective view of the carrying case embodiment in the partially open disposition;

FIG. 3 is a perspective view of the arrangement in the inverted transition phase between the carrying case embodiment and the beach blanket embodiment; and FIG. 4 is a perspective view of an alternate version of the partially unfolded beach blanket embodiment of the invention.

DETAILED DESCRIPTION OF THE INVENTION

As can be seen by reference to the drawings, and in particularly to FIG. 1, the combined beach blanket and carrying case arrangement that forms the basis of the present invention is designated generally by the reference number 10. In addition, FIGS. 1 and 2 depict the carrying case embodiment of the invention, FIG. 4 depicts the beach blanket embodiment of the invention and FIG. 3 depicts the transition phases between the two embodiments of the invention.

The arrangement 10 comprises in general, a main fabric unit 11, a plurality of releasably fastening units 12 and a sling unit 13. These units will now be described in seriatim fashion.

As can best be seen by reference to FIGS. 3 and 4, the main fabric unit 11 comprises an elongated generally rectangular single thickness fabric panel member 20 which when fully extended comprises the main body 21 of the beach blanket 50 and a double thickness fabric envelope 30 which is segregated into an enlarged main compartment 31 and a pair of side compartments 32, 33 which constitute the head of the blanket 50.

Still referring to FIGS. 3 and 4, it can be seen that the plurality of releasable fastening units 12 comprises a hook and loop fastener member 40 on the exterior of the main compartment 31 and the interior of the open tops of the side compartments 32 and 33 in one version of the preferred embodiment depicted in FIG. 3, and the plurality of releasable fastening units 12 in the version depicted in FIG. 4 comprise a hook and loop fastener member 40 on the exterior of the main compartment and a zipper fastener member 41 on the outside edges of the side compartments 32, 33.

In the first version depicted in FIGS. 2 and 3, the top openings in the side compartments 32, 33 are provided to accommodate oversized articles such as water bottles, brushes, etc. In the second version depicted in FIG. 4, the side zippers 41 provide secure hidden closures for articles such as keys, money, jewelry, etc. in either the carrying case (FIGS. 1 and 2) or the beach blanket (FIGS. 3 and 4) embodiments of the invention.

As can best be seen by reference to FIGS. 1 and 2, the sling unit 13 comprises a carrying handle 60 that is secured to the exterior seams 35 of the main storage compartment when the arrangement 10 is in the carrying case mode.

In order to convert the arrangement 10 from the carrying case mode of FIGS. 1 and 2 to the beach blanket mode of FIGS. 3 and 4, all that is required is for the main storage compartment 31 to be turned inside out which will cause the side compartments 32 and 33 to move from a storage position of FIG. 2 within the main storage compartment 31 to the position depicted in FIG. 3 wherein the side compartments 32, 33 are deployed on the outside of the main compartment 31.

At this juncture, the blanket body 50 is unrolled and unfolded and the user's outer clothing or beach coverings can be placed inside the inverted main storage compartment 31 to form a cushioned headrest for the arrangement 10 in a well recognized fashion.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A combined blanket carrying case arrangement comprising:

a main fabric unit including an elongated single thickness fabric panel member wherein the single thickness fabric panel member has a first end and a second end connected to a double thickness fabric envelope wherein the double thickness fabric envelope defines a plurality of storage compartments including a main storage compartment and a pair of side storage compartments each having a lower end connected to the upper end of the single thickness fabric panel member; wherein each of the storage compartments has an upper end facing away from the single thickness fabric panel member and defining a compartment opening;

a sling unit including a strap member having opposite ends operatively associated with selected portions of said fabric envelope; and a plurality of fastening units operatively associated with the compartment opening in the upper end of each of said plurality of storage compartments for closing both the side storage compartments and for enclosing both the side storage compartments and said single thickness fabric envelope.

2. The arrangement as in claim 1 wherein the fastening unit for the main storage compartment comprises hook and loop fastening members.

3. The arrangement as in claim 1 wherein at least one of said fastening units comprise hook and loop fastener members and another of said closure units comprises a zipper fastener member.

4. The arrangement as in claim 1 wherein at least one of said fastening units comprise zipper fastener member.

5. The arrangement as in claim 3 wherein said hook and loop fastener members are disposed on the upper end of one of said storage compartments and said zipper fastener member is disposed along the outside of one of said side storage compartments.

6. The arrangement as in claim 1 wherein the opposite ends of the strap unit are connected to the opposite sides of the main storage compartment.

7. The arrangement as in claim 1 wherein said main storage compartment is dimensioned to receive both the single thickness fabric panel member and both of said side storage compartments.

* * * * *